US005673460A

United States Patent [19]

Domenig

[11] Patent Number: 5,673,460

[45] Date of Patent: Oct. 7, 1997

[54] HINGE

[75] Inventor: Georg Domenig, Kernersville, N.C.

[73] Assignee: Grass AG, Hochst/Vlbg., Austria

[21] Appl. No.: 470,226

[22] Filed: Jun. 6, 1995

[51] Int. Cl.[6] ..... E05D 5/02

[52] U.S. Cl. ..... 16/387

[58] Field of Search ..... 16/236, 240, 243, 16/249, DIG. 43, 387, 366, 370, 302, 287

[56] References Cited

U.S. PATENT DOCUMENTS 4,470,169 9/1984 Lautenschlager et al. ..... 16/370

4,502,182 3/1985 Lautenschlager et al. ..... 16/288

FOREIGN PATENT DOCUMENTS 1516876 3/1968 France ..... 16/370

*Primary Examiner*—Chuck Y. Mah
*Assistant Examiner*—Donald M. Gurley
*Attorney, Agent, or Firm*—Kilpatrick Stockton; John M. Harrington

[57] ABSTRACT

A hinge with a hinge cup and a hinge arm is described which inserts in a cabinet/furniture component. The hinge cup has a recess located on the outer side of the side which is opposite the hinge arm, so that a step is formed in the inner space of the hinge cup.

4 Claims, 3 Drawing Sheets

HINGE

BACKGROUND OF THE INVENTION

The invention is a hinge with a hinge cup and a hinge arm; a hinge to be used especially for cabinets/furniture which have a frame and an inserted panel filler.

The frame is, as a rule, constructed of a solid and hard material while the panel filler is made of a relatively sensitive (especially to moisture) material.

In order to install the hinge, the hinge cup of the hinge is placed into the bore hole located in the frame. The problem with this is that usually this bore hole also engages in the panel filler. So, therefore, the hinge cup is not only placed on the frame, but also on the panel filler.

So if the panel filler expands or swells, especially as a result of moisture, it comes into contact with the hinge cup and pushes it out of the receptacle bore hole in the frame.

It is possible to make the frame wider so that the corresponding receptacle bore hole no longer engages the panel filler. This is a disadvantage because a relatively wider frame must be used. This wide frame leads to an increase in weight because a greater quantity of high quality materials must be used which, in turn, means correspondingly higher costs.

An object of the submitted invention is to provide a hinge with a hinge cup that will hold well in the respective bore hole.

An additional object of the submitted invention is to provide a hinge with a hinge cup that allows for the expanding or swelling of the panel filler without affecting the fixed position of the hinge cup in the frame.

Another object of the invention is to provide a hinge which fulfills the above mentioned functions and simultaneously, can also be utilized together with a previously known hinge arm.

SUMMARY OF THE INVENTION

These and other objects of the invention are attained by a hinge with a hinge cup and a hinge arm, which is placed movable on the hinge cup, and whereby; the hinge cup, which has the hinge arm attached, has a recess on the opposite side of its outer side.

In this way a step in the inner space of the hinge cup is formed.

So if the panel filler expands or swells, it reaches the area of this recess, and does not come into contact with the hinge cup. The hinge cup holds from now on reliably in the receptacle bore hole in the frame despite the expansion of the panel filler.

The step preferably comprises successive segments that are placed substantially right-angled to each other.

| Legend for the Figures | |
|---|---|
| 1 | Hinge |
| 2 | Hinge cup |
| 3a, 3b | Cover flanges |
| 4a, 4b | Hole |
| 5 | Hole |
| 6 | Innerspace |
| 7 | Step |
| 8 | Segment |
| 9 | Segment |
| 10 | Segment |
| 11 | Recess |
| 12 | Frame |
| 13 | Panel filler |
| 14 | Bore hole |
| 15 | Hinge arm |
| 16 | Cabinet/furniture component |
| 17 | Recess |
| 18 | Axis |

DESCRIPTION OF A PREFERRED EMBODIMENT

The achievement of the foregoing objects becomes more clear by the views of the Figures which are shown individually.

Figure 2:
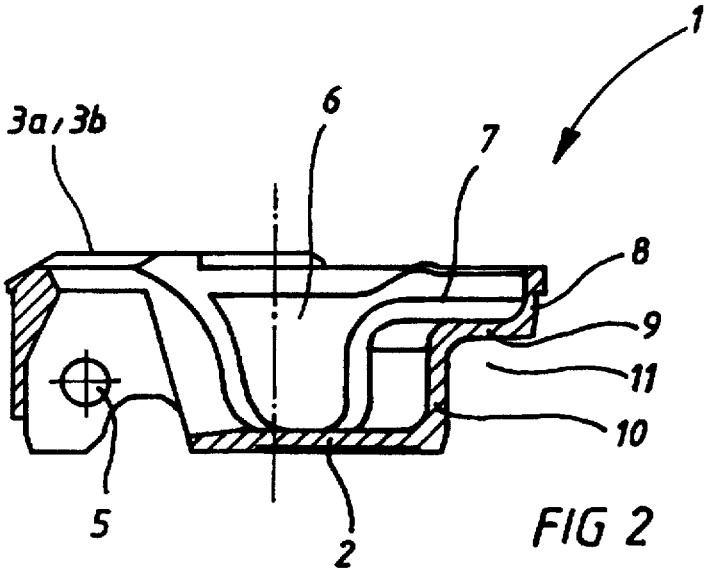
FIG. 2: A section along Line AA in FIG. 1.
Figure 1:
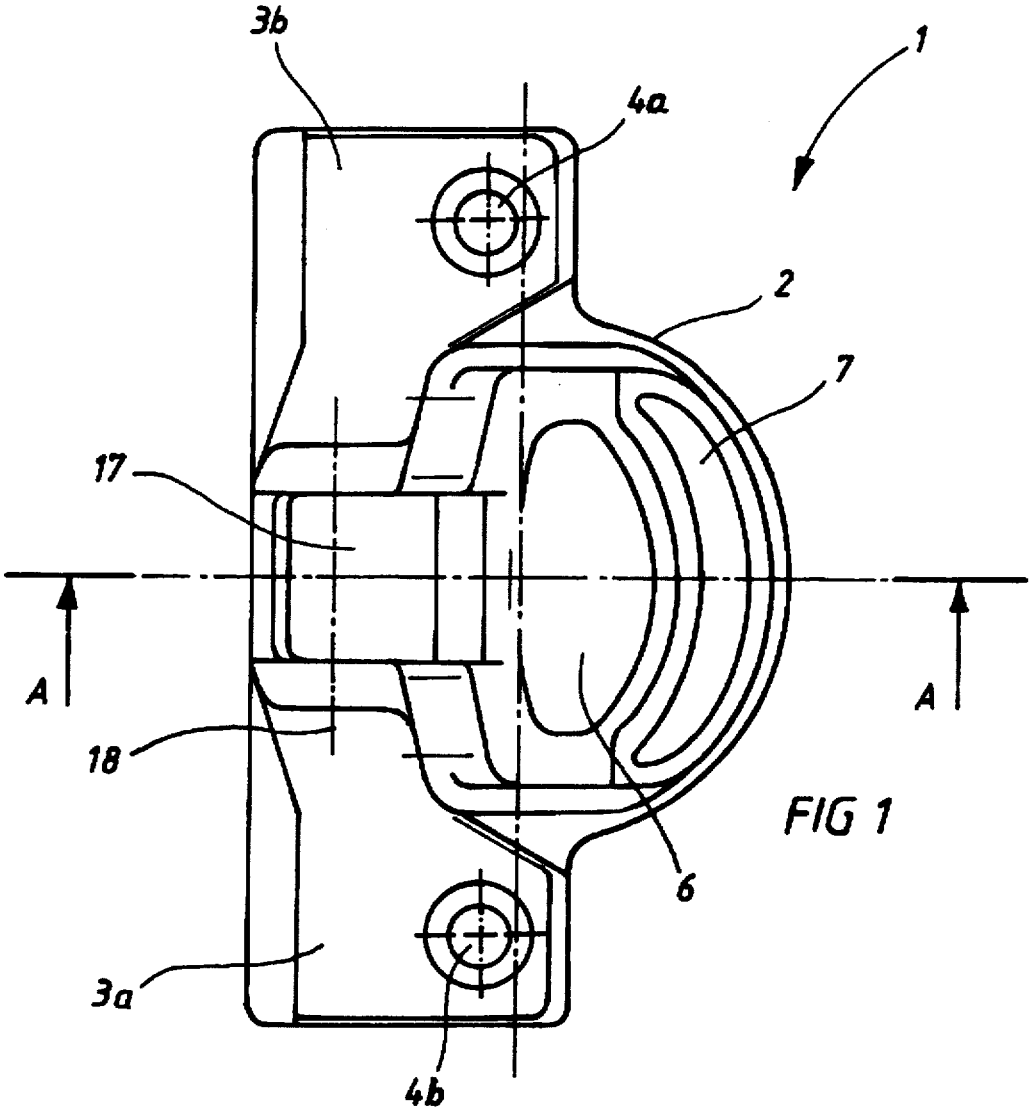
FIG. 1: A top view of the innovation related hinge.

In FIGS. 1 and 2, the hinge is shown with the reference mark (1). It (the hinge) has a hinge cup (2) which is formed fundamentally round. In order to be fastened on a cabinet/furniture component, the upper side of the hinge has laterally projecting flanges (3*a*, 3*b*) which are provided with one or more holes (4*a*, 4*b*) in which to place the fastening screws.

Moreover, a hole (5) is provided to attach a hinge arm. The hinge arm, is hereby, inserted in a recess (17) and is fastened with a not closely represented shaft whose longitudinal axis is the axis (18).

The hinge cup (2), has, beyond that, an inner space (6) into which the hinge arm engages at least partially in the various opening positions of the hinge (1)

In order to make allowances for the panel filler expanding or swelling, the hinge cup (2) has a step (7) on the end opposite the hole (5). The step (7) consists, hereby, of a first, somewhat vertical gradient segment (8), which is formed to fit in the somewhat circular shaped hinge cup (2). This segment (8) is joined by a second segment (9) which runs basically parallel to the bottom of the hinge cup (2) and is also horizontal in FIG. 2. This segment is again joined by a third segment (10) which again runs basically perpendicular, and based on the style of construction, can be formed straight or circular shaped. These segments (8–10) define a recess (11) on the outer side of the hinge cup (2), into whose area the panel filler can expand.

Figure 3:
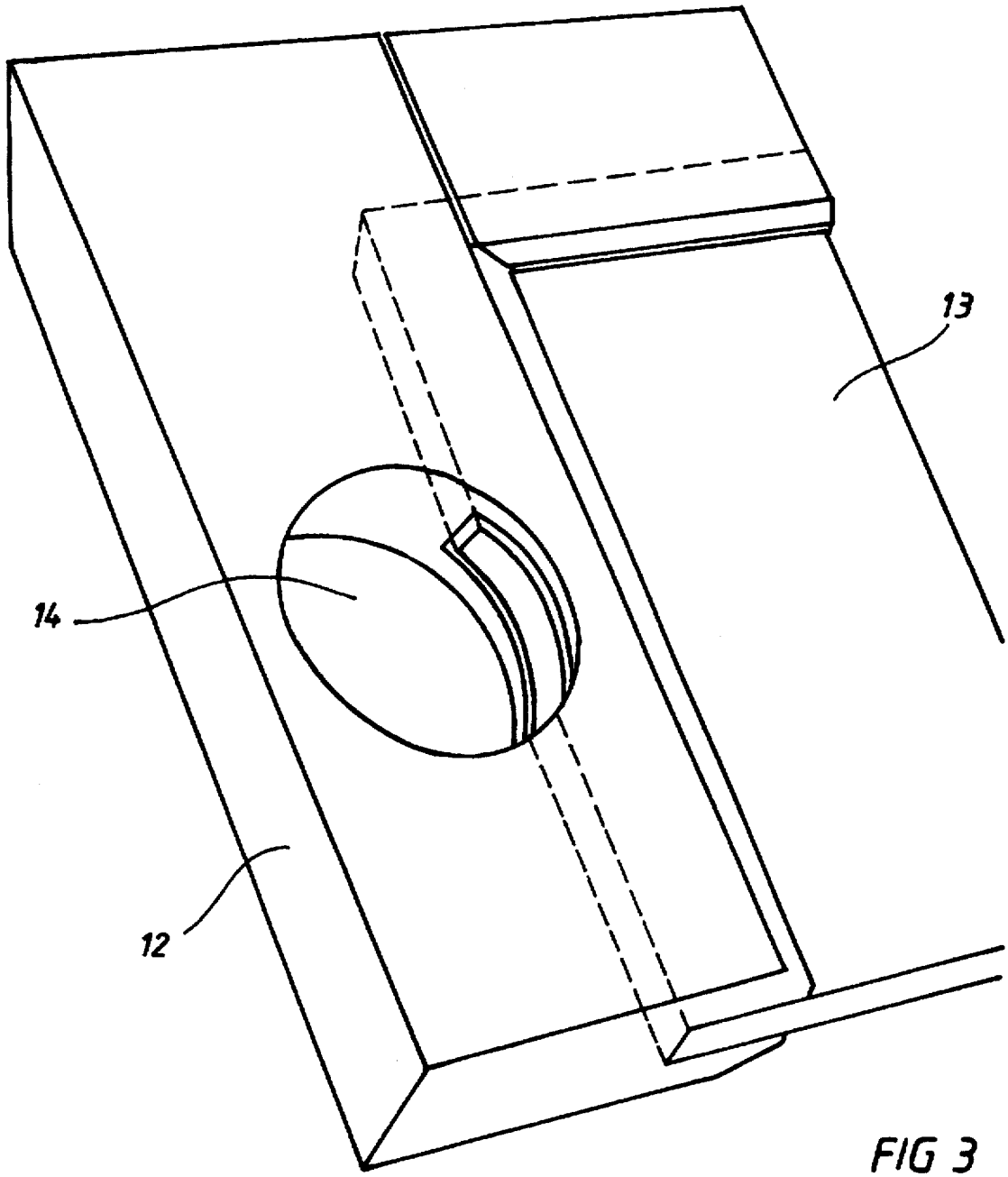
FIG. 3: A perspective view of a frame with a panel filler and a receptacle bore hole.

FIG. 3 shows a section of a cabinet/furniture component which consists fundamentally of a one or more part frame (12), as well as one which has a panel filler (13) which has been "taken into" the frame. The frame is preferably assembled with single elements so that a somewhat rectangular form results. The panel filler (13) is, hereby, inserted in a groove on the inner side of the frame.

When placing a bore hole (14) for the hinge cup, it is clearly shown in the embodiment that this bore hole is placed not only in the frame (12), but also engages the panel filler (13). The peripheral edges of the panel filler (13) are hereby marked with dotted lines in FIG. 3.

By placing the hinge (1) in the bore hole (14), the panel filler (13) lies over against the resulting recess (11) of the step (7). An expansion or swelling of the panel filler takes place in this recess (11) so that the hinge cup continues to hold securely and fixed in the frame (12).

Figure 4:
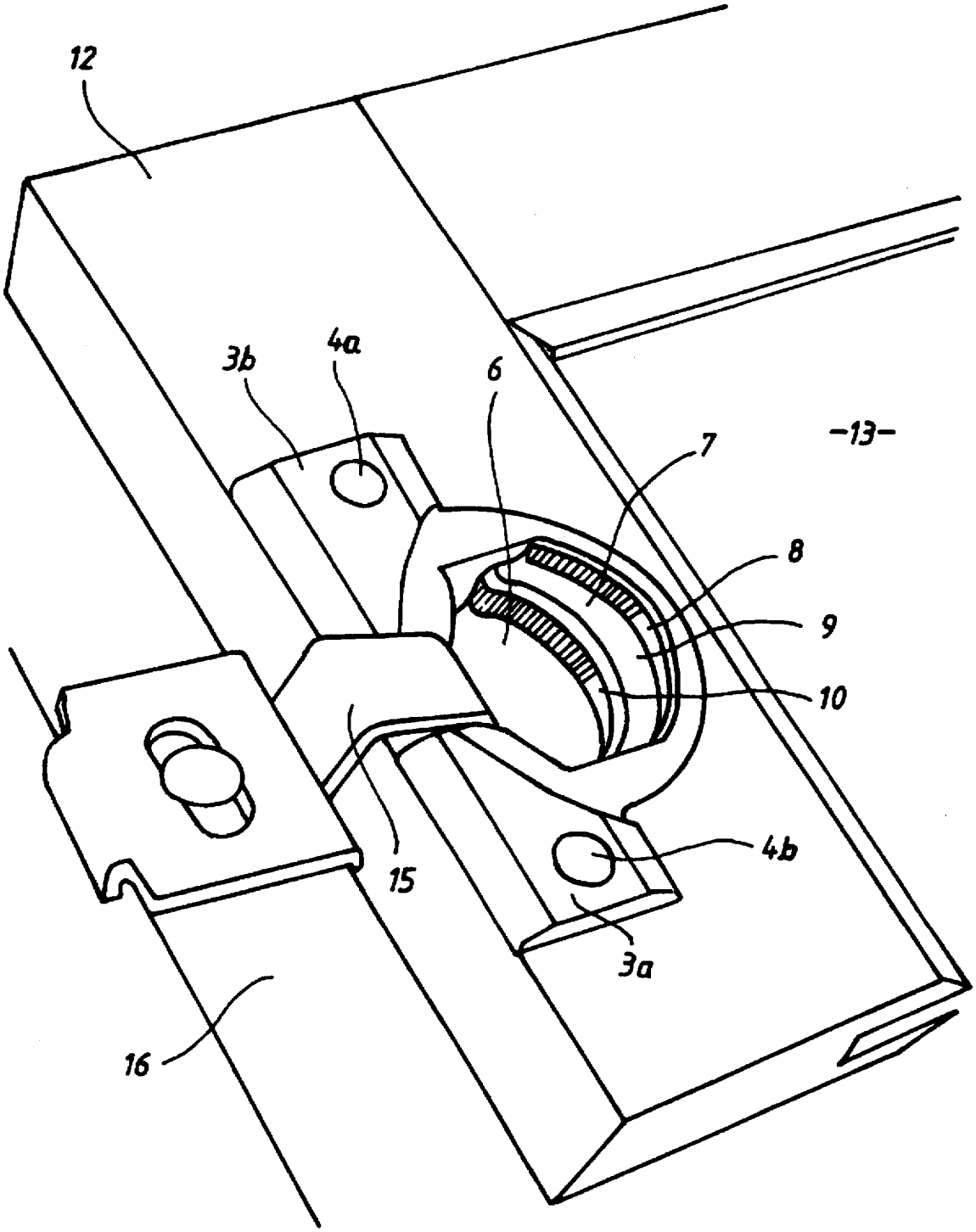
FIG. 4: A view according to FIG. 3; whereby, the hinge, according to FIGS. 1 and 2, is inserted in the receptacle bore hole.

FIG. 4 shows the invention-related hinge inserted in the bore hole (14). This embodiment clearly indicates the step (7) which consists of the three above mentioned segments (8–10). It is clearly indicated that a relatively large inner space is provided into which the hinge arm (15) can swing. The hinge arm (15), in turn, is fastened in an already known manner to a cabinet/furniture component (16).

The following claims are intended to cover all of the generic and specific features of the invention herein described and all statements of the scope of the invention which, as a matter of language, might be said to fall therebetween.

What is claimed is:

1. A hinge for a cabinet having a frame with an attached filler panel comprising: a hinge cup having an outer side and with an attached movable hinge arm, wherein the hinge cup is fastened in a bore hole formed in the frame and has a step on the outer side which lies opposite the hinge arm and forms a recess between the step and the bore hole for receiving a peripheral edge of the filler panel.

2. The hinge of claim 1 wherein the step further comprises three adjoining segments disposed substantially perpendicular to one another.

3. The hinge of claim 2 wherein the hinge cup further comprises cover flanges having fastening holes for fastening the hinge cup to a furniture component.

4. The hinge of claim 1 wherein the hinge cup further comprises cover flanges having fastening holes for fastening the hinge cup to a furniture component.

* * * * *